United States Patent [19]

Gantz et al.

[11] Patent Number: 4,461,050

[45] Date of Patent: Jul. 24, 1984

[54] AUTOMATIC BEAM CLEANING MACHINE

[75] Inventors: James L. Gantz; Marcus C. Martin, both of Columbia, S.C.

[73] Assignee: Allied Corporation, Morristown, N.J.

[21] Appl. No.: 334,661

[22] Filed: Dec. 28, 1981

[51] Int. Cl.[3] ..... B08B 1/00

[52] U.S. Cl. ..... 15/3; 15/21 B; 15/88; 51/58; 51/67

[58] Field of Search ..... 15/21 R, 3, 21 B, 21 C, 15/21 D, 56, 57, 58, 70, 88, 104.04; 134/6; 51/58, 67, 154, 161; 28/292, 295, 296, 298

[56] References Cited

U.S. PATENT DOCUMENTS 2,584,915 2/1952 Pogacsnik ..... 51/67
2,710,440 6/1955 Bauer ..... 28/296
3,680,165 8/1972 Garst et al. ..... 15/56
4,125,087 11/1978 Ronning ..... 15/104.04 X

*Primary Examiner*—Edward L. Roberts
*Attorney, Agent, or Firm*—Richard A. Negin; Patrick L. Henry; Richard A. Anderson

[57] ABSTRACT

An apparatus for cleaning spools having a support means and a first and second chuck rotatably mounted on the support means. The first and second chucks having coinciding axes of rotation with first chuck facing the second chuck. There is at least one cleaning arm having a supported end and a free end. The cleaning arm is supported at a location so that the free end of the cleaning arm is offset from the axis of rotation of the chucks. There is a means to rotate at least one of the chucks and a means to move the free end of the cleaning arm parallel to the axis of rotation of the chucks.

11 Claims, 4 Drawing Figures

AUTOMATIC BEAM CLEANING MACHINE

BACKGROUND OF THE INVENTION

This invention is in the field of automatic cleaning apparatus; more particularly this invention relates to an automatic spool cleaning apparatus.

In many industries spools are used on which to coil or wrap sheets of material, cables, wire, fibers, yarn, and the like for storage, use, and transporation. For the purpose of this invention a spool is considered to be a cylinder having at least one circumferential ridge along the outer diameter of the cylinder. Typically, the ridge is a flange on at least one end of the spool.

Spools are often bulky and heavy making them very difficult to handle. Often the items, which are wrapped on the spool, must be kept clean and free from defects. To accomplish this the spools must be kept clean. Presently, the spools are handled by conventional type lifting equipment, such as winches and straps, and the cleaning is done by hand.

SUMMARY OF THE INVENTION

The present invention is an apparatus having a support means and a first and second chuck rotatably mounted on the support means. The first and second chuck have coinciding axes of rotation with the second chuck facing the first chuck. There is at least one cleaning arm having a supported end and a free end. The cleaning arm should have at least one cleaning means attaching surface between the supported end and the free end adjacent to the free end. The cleaning arm is supported at a location so that the free end of the cleaning arm is offset from the axis of rotation of the first and second chucks. There is a means to rotate at least one of the chucks and a means to move the free end of the cleaning arm parallel to the axis of rotation of the chucks.

The apparatus of the present invention is useful for cleaning a spool having a circumferential ridge, particularly a flange on at least one end of the spool and most particularly , a spool having flanges on both ends of the cylinder of the spool.

The apparatus operates to clean a spool mounted between the first and second chuck. There can be a cleaning means removably attached to the cleaning arm. Preferably, the cleaning means attaching surface of the cleaning arm has a hook type fabric structure attached. A loop type cleaning pad can be attached to the hook fabric. The cleaning arm can move axially and clean the surface of the cylinder, and can be pressed against the radial surfaces of the spool flanges as they rotate to clean them. Preferably, the cleaning arm can oscillate radially so that the radial surfaces of the flanges can be cleaned without their surfaces being scored.

Preferably, there is a means to lift the spool to a location between the first and second chuck with the axis of the spool coinciding with the axis of the first and second chucks.

DESCRIPTION OF THE PREFERRED EMBODIMENTS

Figure 1:
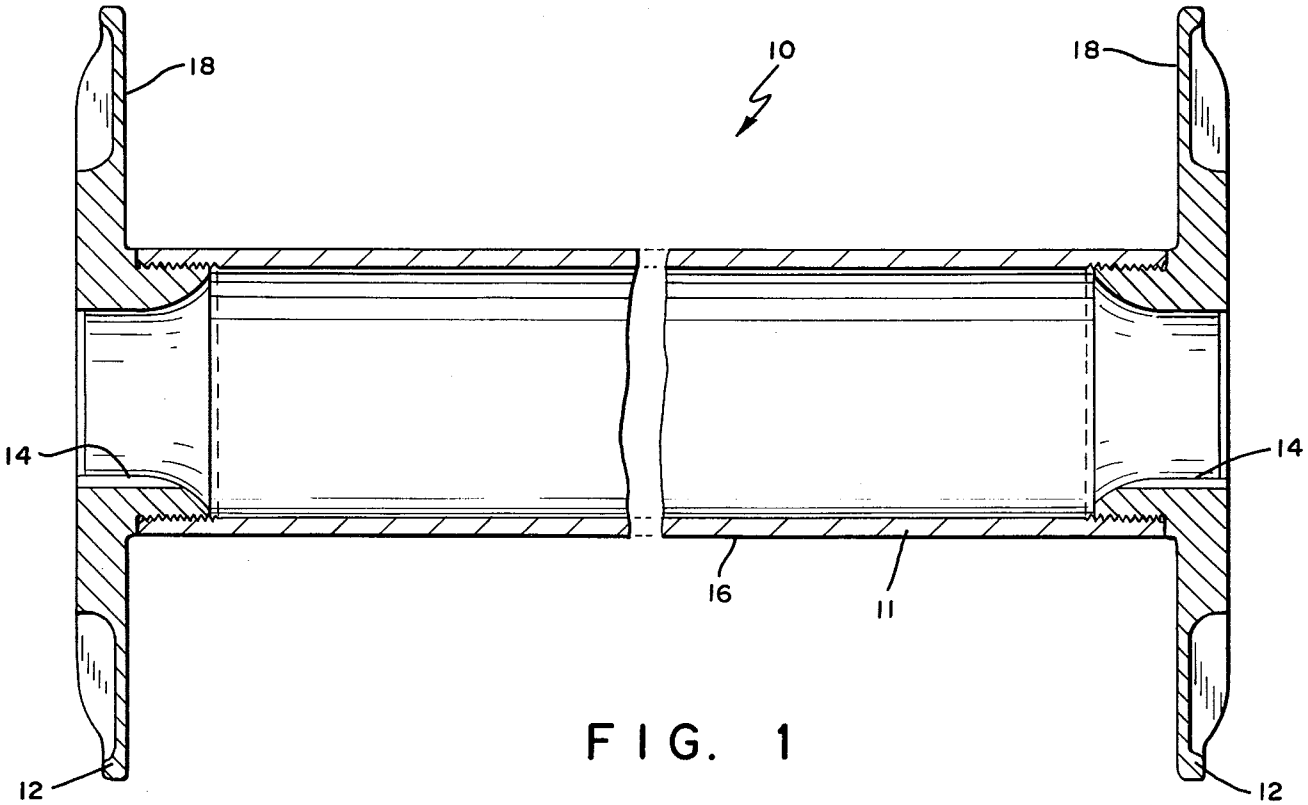
FIG. 1 is a cross-sectional view of a typical beam. A beam is a spool on which yarn is wound.

The present invention will be understood by those skilled in the art by reference to the abovedescribed figures. As indicated in the background, for the purposes of the present invention a spool is considered to be a cylinder having at least one circumferential ridge, particularly a cylinder having a flange on at least one end of the spool. Typically, spools which are contemplated for use with the present invention have circumferential ridges, or flanges at the ends of cylinders. The present invention will be described with reference to such a spool. FIG. 1 shows a spool which is particularly suitable for cleaning by use of the apparatus of the present invention. FIG. 1 is a beam 10 on which yarn is wound for storage and transportation. The beam is comprised of a cylinder 11 and two flanges 12. The flanges are fastened to the ends of cylinder 11. In the beam shown in FIG. 1 the flanges are removably fastened by threads. The flanges 12 have axial openings or end holes 14. The end holes are circular openings. The beams can be mounted on various types of equipment by use of chucks pressing into the opposite end holes 14 of the beam.

Figure 2:
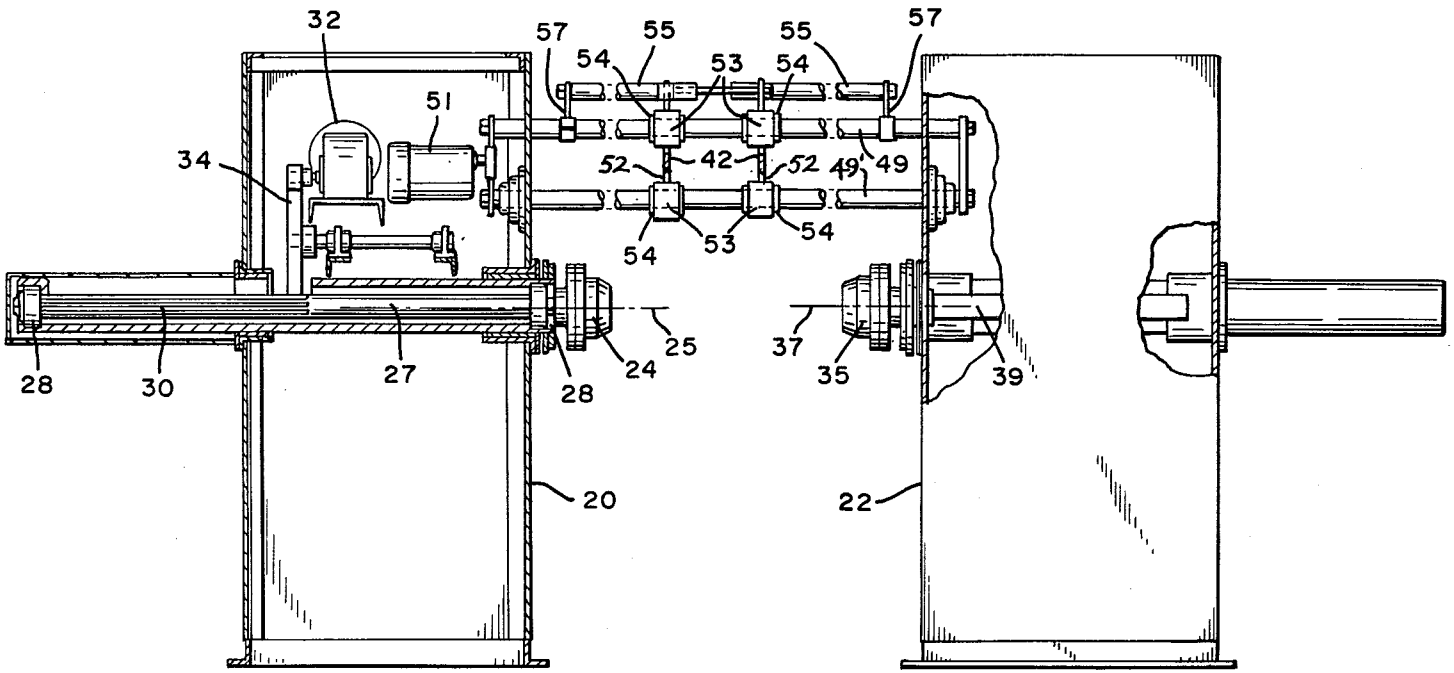
FIG. 2 is a front elevation view of the preferred embodiment of the beam cleaning machine of the present invention.
Figure 3:
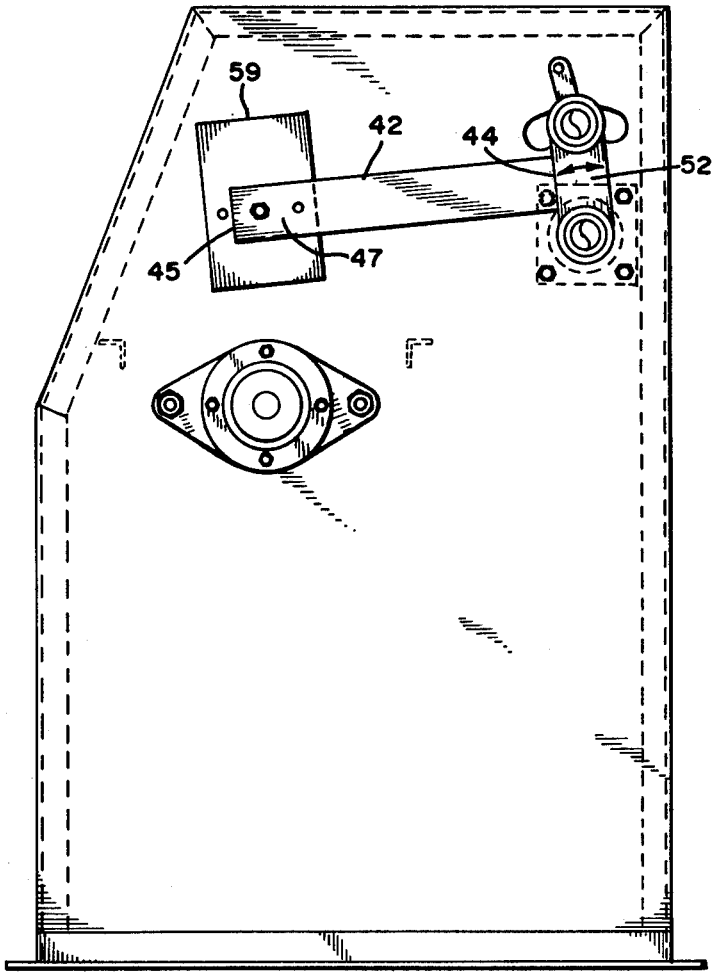
FIG. 3 is a side elevation of the beam cleaning machine shown in FIG. 2.

In the textile industry yarn is wrapped on the cylinder 11 of the beam 10. It is very important to keep the outer cylinder surface 16 and the inside radial flange surfaces 18 clean. This prevents the yarn from getting dirty and prevents foreign particles from causing yarn breakage. Generally, the outer cylinder surface of the beam 10 remains clean since it is covered with yarn. However, during use it has been found that inside flange surfaces 18 are particularly susceptible to picking up dirt. This is because the inside flange surfaces 18 are more frequently uncovered as the yarn which is wrapped around the cylinder 11 is used. The embodiment of the present invention shown in FIGS. 2 and 3 is an apparatus of the present invention which is particularly useful in automatically cleaning the inside flange surfaces 18 of the beams. However, it is recognized that embodiments of the present invention can be used to clean the outer cylinder surface 16 as well as spools other than beams.

Beams can vary in axial and radial dimensions. Typically, the beam is 21 or 42 inches long from the outside surface of the flange on one end to the outside surface of the flange on the opposite end. Each flange has an axial thickness of from $1\frac{1}{2}$ to $2\frac{1}{2}$ inches. The flanges have a diameter which can vary from 20 to about 30 inches with the diameter of the flange a 21 inch beam being about 21 inches and a diameter of the flange of a 42 inch long beam being about 30 inches. The cylinder for a 21 inch long beam is about 6 inches in diameter while that of a 42 inch beam is about 9 inches in diameter. The end holes 14 are circular and approximately 6 inches in diameter. Beams are usually made of cast aluminum but can be made of other metals, wood or plastic.

Generally, the apparatus of the present invention has a support means, such as one or more framed pieces. There is a first chuck rotatably mounted on the support means, the first chuck has a first axis of rotation. There is a second chuck rotatably mounted on the support means. The second chuck has a second axis of rotation coinciding with the first axis of rotation of the first chuck. The first and second chucks should face each other. There is at least one cleaning arm having supported end and a free end. The cleaning arm has at least one cleaning means attaching surface at the free end or between the supported end and the free end adjacent to the free end. Preferably, at least part of the cleaning means attaching surface is perpendicular to the axes of the chucks. A cleaning arm supported is mounted on the support means at a location so that the free end of the cleaning arm is offset from the first axis of rotation. There is a means to rotate at least one of the chucks and a means to move the free end of the cleaning arm parallel to the axis of rotation of the chucks. There can also be a means to move the free end of the cleaning arm in a radial direction. More generally, it is recognized that cleaning means can be attached to the free end of the cleaning arm and the outer cylinder surface 16 can also be cleaned as the cleaning arm moves axially. There is preferably a means to oscillate the cleaning arm radially. Preferably there is a cleaning means which is removably attached at or near the free end of the cleaning arm. There can be a means to lift the spool to a location between the first and second chuck with the axis of the spool coinciding with the axes of the first and second chucks.

A preferred embodiment of the present invention particularly useful in cleaning the inside flange surfaces 18 of beams 10 will be understood by those skilled in the art reference to FIGS. 2 and 3. The support means for the beam cleaning apparatus is shown as a double housing. There is a first housing 20 and second housing 22. A first chuck 24 is rotatably mounted on first housing 20. The first chuck has a first axis of rotation 25. As shown in FIG. 2, the first chuck is connected to a first shaft 27. The shaft passes through first housing 20. The shaft is rotatably mounted to first housing 20 by the use of ball bearings at ball bearing locations 28. The first shaft 27 has shaft gears 30. The first chuck can be driven by the interaction of shaft gears 30 with chuck drive motor 32 through connecting circular gear 34. In this way, first chuck 24 is rotatably mounted to first housing 20 and can be driven or rotated. Second chuck 35 is rotatably mounted on support means such as second housing 22. The second chuck 35 has a second axis of rotation 37. The second axis of rotation coincides, i.e. is coaxial with, the first axis of rotation 25. The second chuck 35 faces the first chuck 24. There can be a means to move the first chuck 24 or second chuck 25 axially toward or away from each other. In the embodiment shown in FIG. 2 this is a pneumatic cylinder 39. The second chuck 35 is rotatably mounted to second housing 22 in a manner similar to the way first chuck 24 is mounted to first housing 22 by ball bearings at locations similar to ball bearing locations 28. A preferred pneumatic cylinder for use in axially moving second chuck 35 is a Modernair No. 04 5-1001-19 air cycle double acting, 1½ inch bore by 19 inch stroke pneumatic cylinder.

There is at least one cleaning arm 42 (shown in FIG. 3). In the embodiment shown in FIGS. 2 and 3, there are two cleaning arms 42. Each cleaning arm has a supported end 44 and a free end 45. There is at least one cleaning surface between the supported end 44 and the free end 45 adjacent to the free end 45. Cleaning means attaching surface 47 is near free end 45. The cleaning means attaching surface 47 shown in the embodiment of the present invention in FIGS. 2 and 3 are on the sides of cleaning arm 42 indicated in FIG. 3. In FIG. 3, cleaning means attaching surface 47 is on the back side of cleaning arm 42 at the location indicated. The cleaning arms 42 are mounted on cleaning supports which in turn are mounted on the support means at a location so that the free end 45 of the cleaning arm is offset from the first axis of rotation 25. The free end 45 of the cleaning arm is located at a distance from the axis of rotation at least the radius of the cylinder of a mounted spool.

The cleaning arm supports shown in FIG. 2 are support bars 49 and 49'. These bars are connected to support bar motor 51. Support bar motor 51 oscillates the support bar 49 so that the free end 45 of cleaning arm 42 moves radially with respect to the first and second axes of rotation, 25 and 37. The cleaning arms 42 are mounted on support bars 49 so that they may move in a direction parallel to the first and second axes of rotations. This is accomplished by the supported end 44 connected to holders 53 by supported end connector 52. The holders 53 are slidably mounted on support bars 49 by bushing 54. The holders in turn are connected to cleaning arm pneumatic cylinders 55. The cleaning arm pneumatic cylinders 55 can be supported on support bars 49 or on first housing 20 and/or second housing 22. The cleaning arm pneumatic cylinders 55 are supported by the support bars 49 through support connectors 57. In the embodiment of the present invention shown in FIGS. 2 and 3 the cleaning arm pneumatic cylinders 55 are directed to move cleaning means attaching surface 47 toward first chuck 24 and cleaning means attaching surface 47' toward second chuck 35. When a spool such as beam 10 is mounted between chucks 24 and 35 the surfaces 47 and 47' can be forced against the inside flange surfaces 18 of the beam 10.

In the embodiment of the present invention shown in FIGS. 2 and 3, a pad 59 is connected to the cleaning surfaces 47 and 47' of each cleaning arm 42. The pad 59 can have a suitable removable cleaning means attaching thereto. The exposed surface of pad 59 attached to cleaning means attaching surface 47 faces first chuck 25, and the surface of brush pad 59' (not shown) attached to cleaning means attaching surface 47' faces chuck 35. The facing surface of each pad can have a removably attached cleaning means. For example, the cleaning surface of pad 59 snd 59' can have hooks of the type used in hook and pile fabric. These hooks can be attached to a cleaning means such as fabric type scouring pads made of metal or, polymeric or textile type materials.

Optionally, there can be a means to lift the spool or beam 10 to a location between first chuck 24 and second chuck 35 so that the axis of the beam is coaxial with first axis of rotation 25 and second axis of rotation 37. The beam can then be locked between the first chuck 24 and second chuck 35 for the cleaning operation.

Figure 4:
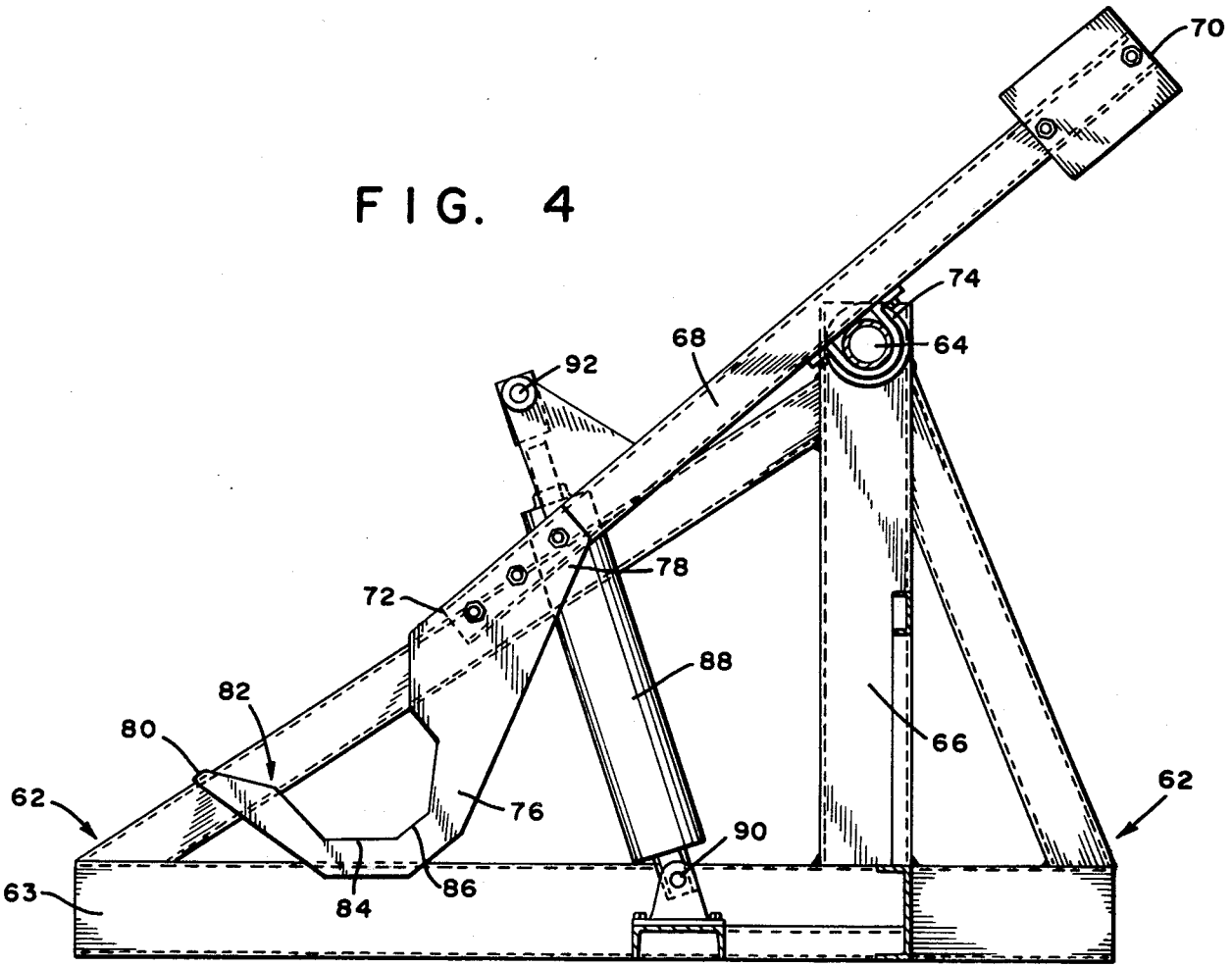
FIG. 4 is a side elevation of a beam lifting device useful in the present invention.

The preferred means to lift the spool for use with the present invention will be understood by those skilled in the art by reference to FIG. 4. The lifting means shown in FIG. 4 has a base means. The base means can be the floor or the frame base 63 of a support frame generally shown as 62. There is a fulcrum means supported on the base. In FIG. 4, the fulcrum is fulcrum bar 54, which is a cylindrical bar. Fulcrum bar is supported on support frame 64 by fulcrum support 66. There is at least one lifting arm 68 and preferably two lifting arms 68. The lifting arm 68 has a lifting arm free end 70 and a lifting arm lifting end 72. The lifting arm 70 is pivotably connected to fulcrum bar 64, between the free end 70 and the lifting end 72. The lifting arm 68 can be pivotably connected to fulcrum bar 64 by tube bushings 74 connected to lifting arm 64 with fulcrum bar 64 passing through the tube bushing 74. There is a lifting claw 76 connected to the lifting arm lifting end 72. The claw has one claw attached end 78 attached to the lifting end 72 of the lifting arm 68 and a claw opposite end 80. The claw has a concave portion 82 between claw attached end 78 and claw opposite end 80, directed away from the base means or bottom of support frame 62. The cylinder 11 of beam 10 is supported in the concave portion 82 of the claw. Preferably, the concave portion is faceted. In the most preferred embodiment there is one facet, base facet 84, which is horizontal when the claw is in contact with the frame base 63. Additionally, the preferred claw can have one facet, lift facet 86, which is parallel to the axis through the lifting arm 68.

There is an extendable lifting means such as hydraulic cylinder 88 pivotably connected to the lifting arm 68 between the fulcrum means and the lifting end 72 at one end. The extendable lifting means is pivotably connected to the base such as base frame 63 on the opposite end. Referring to FIG. 4, hydraulic cylinder 88 is pivotably connected at base pivot 90 to base 63. The hydraulic cylinder is pivotably connected to lifting arm 68 between the tube bushing 74 and lifting arm lifting end 72 at lifting arm pivot 92. Preferably, lifting arm free end 70 is long enough or weighted so that there is an approximate balance of weight on both sides of fulcrum bar 64. This allows the lifting of the lifting arm lifting claw 76 with a minimum of effort.

The operation of the apparatus of the present invention will be described with reference to FIGS. 2-4 for the cleaning of the inside flange surface 18 of beam 10 shown in FIG. 1. In the first step, beam 10 is placed on the concave portion 82 of lifting claw 76. The cylinder 11 should fit or be supported in concave portion 82. Once the beam is in place in the lifting claw 76 the hydraulic cylinder 88 lifts the lifting arm lifting end 72 so that the axis of cylinder 11 is coaxial with the first axis or rotation 25 and the second axis of rotation 37. Pneumatic cylinder 39 forces second chuck 35 toward first chuck 24 so that the chucks enter end holes 14 of beam 10. It is recognized that any suitable type of chuck can be used which is compatible with a suitable fastening means on a corresponding spool to be cleaned in the apparatus of the present invention. Once the beam is held in place between the two chucks, the lifting claw can be brought back to the frame base 63. At this time, chuck drive motor 32 can be turned on to cause chuck 24 to begin to rotate and thereby drive the beam 10 and second chuck 35 through beam 10. The cleaning arm pneumatic cylinders 55 then can force pads 59 in the direction of their corresponding inside flange surfaces 18. Once contact is made by the pad with the inside flange surfaces 18, or before contact is made, support motor 51 can optionally be turned on to cause radial oscillaations of the cleaning means as the cleaning means is pressed against the flange surface 18. At a predetermined time or when the inside flange surfaces are observed to be clean, the cleaning and pneumatic cylinders will release the brush pads and the chuck drive motor can be turned off. The claw 76 can be lifted so that the cylinder 11 is nested in concave portion 82. At this time, pneumatic cylinder 39 can cause withdrawal of second chuck 35 and the beam will be fully supported by claw 76. Claw 76 can then automatically be lowered by hydraulic cylinder 88 to frame base 63.

It is understood that variations and modifications of the present invention may be made without departing from the scope thereof.

What is claimed is:

1. An apparatus for cleaning a spool having a cylinder and at least one circumferential ridge having a radially extending surface comprising:

a support means;

a first chuck rotatably mounted on the support means, the first chuck having a first axis of rotation;

a second chuck rotatably mounted on a support means, the second chuck having a second axis of rotation coinciding with the first axis of rotation, and the second chuck facing the first chuck;

at least one cleaning arm, the cleaning arm having a supported end, and a free end, and at least one cleaning means attaching surface between the supported end and the free end adjacent to the free end;

a cleaning means attached to said attaching surface, said cleaning means comprising pad means having a surface substantially perpendicular to said first axis of rotation;

a cleaning arm support mounted on the support means at a location so that the free end of the cleaning arm is located at the distance from the axis of rotation of at least the radius of a mounted cylinder;

a means to move the free end in a radial direction; and a means to move the free end parallel to the first axis of rotation to contact the radially extending surface.

2. The apparatus as recited in claim 1 further comprising a cleaning means where said surface of said pad means has a removably attached cleaning means.

3. The apparatus as recited in claim 2 wherein there is a means to rotate the cleaning arm about an axis perpendicular to the length of the cleaning arm.

4. The apparatus as recited in claim 1 wherein there is a means to oscillate the cleaning arm in a plane perpendicular to the axis of rotation.

5. The apparatus as recited in claim 4 wherein the cleaning arm is radially oscillated.

6. An apparatus for cleaning a spool having a cylinder and a flange having a radially extending surface at at least one end of the spool comprising:

a support means;

a first chuck rotatably mounted on the support means, the first chuck having a first axis of rotation;

a second chuck rotatably mounted on the support means, the second chuck having a second axis of rotation coinciding with the first axis of rotation, and the second chuck facing the first chuck;

at least one cleaning arm, the cleaning arm having a supported end, a free end, and at least one cleaning means attaching surface between the supported end and the free end adjacent to the free end;

a cleaning means attached to said attaching surface, said cleaning means comprising pad means having a surface substantially perpendicular to said first axis of rotation;

a cleaning arm support mounted on the support means at a location so that the free end of the cleaning arm is located at a distance from the axis of rotation of at least the radius of a mounted cylinder;

a means to move the free end in a radial direction; and a means to move the free end parallel to the first axis of rotation to contact the radially extending surface.

7. The apparatus as recited in claim 6 further comprising a cleaning means where said surface of said pad means has a removably attached cleaning means.

8. The apparatus as recited in claim 7 further comprising hook and pile fabric attached to said pad means, wherein the removably attached cleaning means is attached to said pad means by the hook and pile fabric.

9. The apparatus as recited in claim 6 further comprising a means to radially oscillate the cleaning arm.

10. The apparatus as recited in claim 6 further comprising a means to lift the spool to a location between the first and second chuck with the axis of the spool coinciding with the axis of the first and second chucks.

11. The apparatus as recited in claim 10 wherein the means to lift the spool comprises:

a base;

a fulcrum means supported on the base;

at least one lifting arm having a free end and a lifting end, the lifting arm pivotably connected to the fulcrum means between the free end and the lifting end;

a lifting claw connected to the lifting end of the lifting arm; and an extendable lifting means pivotably connected to the lifting arm between the fulcrum means and the lifting end at one end and pivotably connected to the face on the opposite end.

* * * * *